US006277233B1

(12) United States Patent
Daley

(10) Patent No.: US 6,277,233 B1
(45) Date of Patent: Aug. 21, 2001

(54) CUSTOMIZED CUSHIONED FLOOR MAT AND METHOD OF PRODUCING SAME

(75) Inventor: Scott G Daley, Port Hueneme, CA (US)

(73) Assignee: Pacific Foam Technologies, Ventura, CA (US)

( * ) Notice: Subject to any disclaimer, the term of this patent is extended or adjusted under 35 U.S.C. 154(b) by 0 days.

(21) Appl. No.: 08/927,935

(22) Filed: Sep. 11, 1997

Related U.S. Application Data

(63) Continuation-in-part of application No. 08/790,831, filed on Jan. 28, 1997, now Pat. No. 5,876,825.

(51) Int. Cl.[7] ..... B44C 1/26

(52) U.S. Cl. ..... 156/308.2; 156/324; 15/238; 428/913.3

(58) Field of Search ..... 156/244.11, 244.16, 156/244.27, 245, 227, 308.2, 324; 15/215, 238; 428/913.3

(56) References Cited

U.S. PATENT DOCUMENTS

| | | | | |
|---|---|---|---|---|
| 2,537,126 | * | 1/1951 | Francis, Jr. | 428/165 |
| 3,434,715 | | 3/1969 | Brantingham et al. | 272/57 |
| 3,445,320 | * | 5/1969 | Boivin | 442/222 |
| 3,711,362 | * | 1/1973 | Ballard | 156/219 |
| 3,749,629 | * | 7/1973 | Andrews et al. | 156/244.11 |
| 3,798,111 | * | 3/1974 | Lane et al. | 156/148 |
| 3,804,699 | | 4/1974 | Johnson | 161/39 |
| 3,930,084 | | 12/1975 | Shields | 428/67 |
| 4,187,131 | * | 2/1980 | Shortway et al. | 156/79 |
| 4,277,427 | * | 7/1981 | Kaminski et al. | 264/45.5 |
| 5,015,516 | * | 5/1991 | Lussi et al. | 428/143 |
| 5,169,704 | | 12/1992 | Faust et al. | 428/141 |
| 5,362,544 | | 11/1994 | Reuben | 428/82 |
| 5,413,870 | * | 5/1995 | Flood | 428/542.2 |
| 5,443,885 | * | 8/1995 | Wilson | 428/121 |
| 5,458,953 | * | 10/1995 | Wang et al. | 428/195 |
| 5,645,889 | * | 7/1997 | Potosky et al. | 427/256 |
| 5,776,605 | * | 7/1998 | May | 428/354 |

FOREIGN PATENT DOCUMENTS

| | | | |
|---|---|---|---|
| 2111906 | * | 7/1983 | (GB) . |
| 78-90740 | * | 4/1996 | (JP) . |

* cited by examiner

*Primary Examiner*—Michael W. Ball
*Assistant Examiner*—Barbara J. Musser
(74) *Attorney, Agent, or Firm*—Lyon & Lyon LLP

(57) ABSTRACT

The present invention relates to floor mats, particularly to cushioned floor mats which incorporate a patterned or colored material layer. The present invention comprises a cushioned backing layer of rubber or other thermoplastic elastomer, and a substantially clear top layer of thermoplastic material such as polyvinyl chloride. The present invention further comprises an intermediate substrate layer between the backing and top layers. The intermediate layer preferably comprises a colorful or patterned substrate which is visible through the substantially clear top layer and which provides the mat with an aesthetically pleasing appearance. It is further preferred that the substantially clear top layer include a scuff-resistant surface preformed in the top layer or created by an abrasive process, such as sand blasting. The layers of the floor mat are fused under heat and/or pressure or are bonded using adhesives.

7 Claims, 2 Drawing Sheets

CUSTOMIZED CUSHIONED FLOOR MAT AND METHOD OF PRODUCING SAME

This application is a continuation-in-part of application Ser. No. 08/790,831, filed Jan. 28, 1997 now U.S. Pat. No 5,876,825.

FIELD OF INVENTION

The present invention relates to cushioned floor mats and methods for making them, particularly to a cushioned floor mat which has a customizable aesthetic appearance and a method of customizing such mats.

BACKGROUND

Cushioned floor mats are often used on a hard surface to help reduce the physical stress and fatigue of people standing or walking on the surface for prolonged periods of time. In addition, such floor mats may also protect the underlying floor surface from the wear and tear of traffic passing over it.

Such cushioned floor mats are typically made from a cushioning layer of rubber, foam, or other elastomeric or thermoplastic material. However, plain rubber mats do not appear very attractive, particularly when placed in an environment where decor is important. Some prior art mats have tried to improve this appearance by embedding colored plastic in the mat's top surface or by embossing a pattern into the rubber itself.

Other floor mats have provided somewhat better aesthetic appearance by including a layer of carpeting or elastomeric or thermoplastic tile material on top of the cushioning layer. Typically this additional layer provides a tile or carpet finish to the upper surface of the mat more suitable to a room's design. However, such prior art mats do not allow colorful, delicate patterns, or intricate colors to be selected which coordinate with a room's interior design and decor.

Therefore, a new floor mat is needed, which can incorporate patterned and colored materials and fabrics to coordinate the appearance of the mat with a room's interior decor.

SUMMARY OF THE INVENTION

The present invention comprises a cushioned floor mat which incorporates a patterned or colored material layer allowing the floor mat to be customized. Broadly, the present invention has a cushioned backing layer of rubber or other thermoplastic elastomer, and a substantially clear top layer of thermoplastic material such as polyvinyl chloride. The present floor mat further includes an intermediate layer sandwiched between the backing and top layers. This intermediate layer preferably comprises a colorful or patterned substrate material visible through the top layer which provides the mat with an aesthetically pleasing appearance.

In addition, a mat in accordance with the present invention preferably has a scuff-resistant pattern on the top surface of the substantially clear top layer. The pattern may be sand-blasted onto the surface either before or after the layers of the mat are bonded together. Alternatively, the material used for the top layer may be preformed with the pattern thereon, such as during an extrusion rolling process used to make the material, or the pattern may be pressed into the surface when the layers of the mat are fused together.

Preferably, the three layers (backing, intermediate, and top) are fused together under heat and pressure. Because of these manufacturing conditions, a substrate material for the intermediate layer is preferred which the fusing conditions will not adversely affect. Furthermore, the selected material should maintain flexibility during fusing and subsequent use.

Alternatively, all or some of the three layers may be fused together using adhesives which may be sprayed, brushed or otherwise applied onto one or both of the surfaces of the layers being adhered together.

It is, therefore, a primary object of the present invention to provide a new cushioned floor mat with a pleasing aesthetic appearance, and a method of producing such mats.

Another object of the present invention is to provide a cushioned floor mat which incorporates a substrate layer having a colorful and/or patterned appearance visible when looking at an assembled mat, and a method of manufacturing such mats.

Other objects and features of the present invention will become apparent from consideration of the following description taken in conjunction with the accompanying drawings.

DETAILED DESCRIPTION OF THE PREFERRED EMBODIMENT

Figure 1:
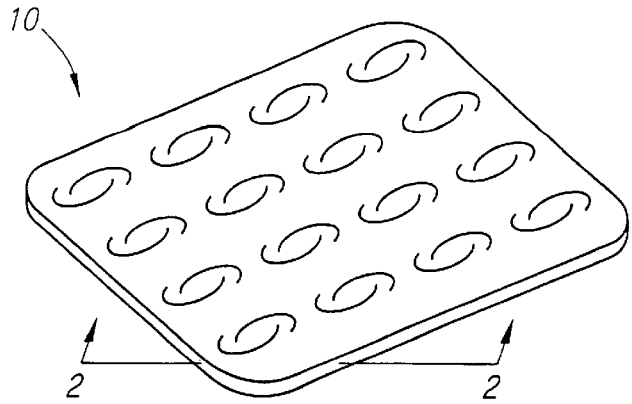
FIG. 1 shows a perspective view of a preferred embodiment of an assembled mat of the present invention.

The present invention comprises a new cushioned floor mat 10, a preferred embodiment of which is shown in FIG. 1. As shown in FIG. 1, the floor mat 10 has a bottom cushioning layer 12, an intermediate substrate layer 14, and a substantially clear top layer 16. The bottom or backing layer 12 provides cushioning and/or resiliency, while the intermediate layer 14 includes a decorative pattern or color. The top layer 16 should be sufficiently clear, rendering the pattern or color on the intermediate substrate layer 14 substantially visible through it.

For the bottom cushioning layer 12, an elastomeric material, such as rubber, is preferred which is both resilient and durable. The material is preferably configured in sheet form, having a thickness of about 6 mm to about 25 mm. Griswold Rubber Company, Moosup, CN for example, produces a foam rubber suitable for this bottom layer. Other materials, such as cross-linked polyethylene foams, may also be used.

The intermediate substrate layer 14 preferably comprises fabric, paper, plastic, foam, or similar material with a colorful and/or decorative pattern incorporated onto its top surface 14*a*. This material should be substantially flexible, and should be able to substantially withstand the processing conditions described below without significant adverse effects (i.e. the material should tolerate heat and pressure). In addition, the material of the substrate layer 14 should be compatible with a preferred adhesive such that the adhesive flows substantially evenly on its surface and adheres substantially to it. Although the material of the substrate layer 14 may absorb the adhesive, preferably such absorption will not be substantial (i.e. no more than about 10% of the adhesive should be absorbed by the foam applied to the substrate).

Of the exemplary materials listed, cloth fabric provides superior durability, while maintaining flexibility after being incorporated into a finished mat. Polyesters or synthetic fabrics are preferred, although natural materials could also be used. In addition, cloth fabrics are commercially available in a wide variety of patterns and colors. Thus, the ultimate user of the mat may select a pattern or color most suited to their particular decor. The end user may even be able to provide their own fabric which they have already selected as part of their interior design.

The substantially clear top layer 16 preferably comprises a thermoplastic elastomer which can withstand the processing conditions described in detail below. For ease of handling during production, this material may be obtained in sheets, preferably having a thickness of between about 1/16 inch and 1/4 inch, with 3/32 inch thickness being most preferred. The material is sufficiently transparent or translucent to enable the pattern or color on the underlying intermediate layer 14 of the assembled floor mat 10 to show through.

Although polyvinyl chloride (PVC), being both durable and readily available, is preferred for this material, other plastics such as polyester, polyurethane, polycarbonate, polyethylene, PET, or PETG have adequate transparency to work as well. Fabricated Extrusion Co. of Modesto, Calif. manufactures a preferred example of a polyvinyl chloride sheet appropriate for use in the clear top layer 16.

In addition, the top surface 16a of the finished mat 10 preferably is substantially scuff-resistant, thus allowing traffic to pass over the top surface 16*a* without marring the aesthetic appearance of the intermediate layer 14 showing through and/or reducing the risk of people slipping on the mat. The material comprising the top layer 16 may be treatable to render the top surface 16*a* scuff-resistant, for example by sand-blasting the top surface 16*a* of the top layer 16 as described below, or by pressing the pattern into the surface when the layers are fused during the bonding process.

Most preferably, the sheets used for the top layer 16 have a scuff-resistant pattern preformed in the top surface 16*a* prior to use, such as when the sheets are initially made. Fabricated Extrusion Co. of Modesto, Calif., for example, manufactures a preferred example of a polyvinyl chloride sheet that has a scuff-resistant pattern formed on its surface during an extrusion rolling process used to manufacture the sheets.

Figure 3:
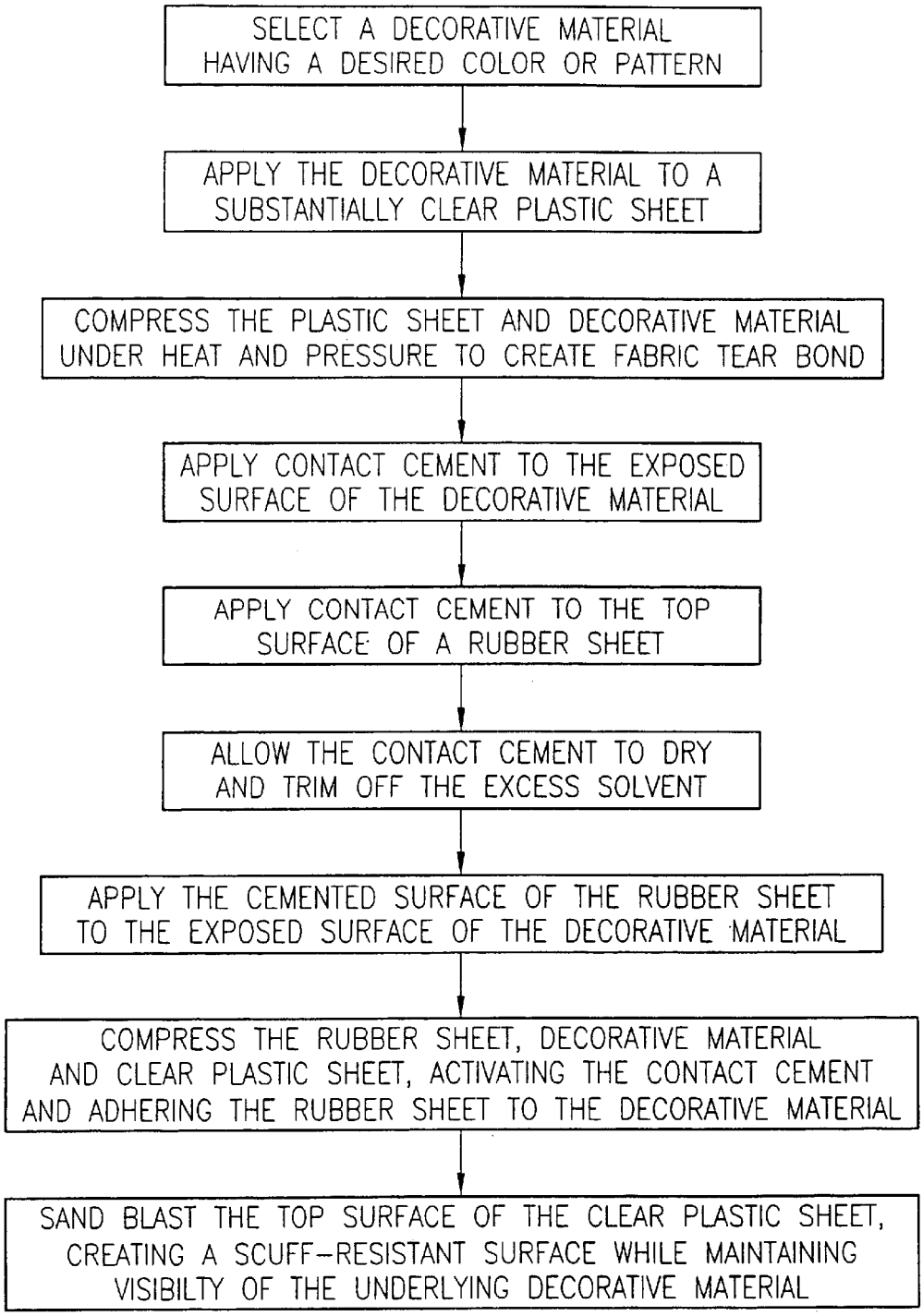
FIG. 3 is a flow diagram of a preferred process of assembling a mat of the present invention.

To produce the finished mat 10, the three layers must be fused or bonded together, for example using the method shown in FIG. 3. A preferred method of assembly of a preferred floor mat of the present invention involves first fusing the intermediate layer 14 to the substantially clear top layer 16. The two layers may be fused by applying an adhesive to the patterned or colored top surface 14*a* of the substrate layer 14, laminating the coated substrate to the bottom surface 16*b* of the material for layer 16, and subjecting the laminated structure to pressure and temperature. Preferred adhesives for use in this process include epoxy, polyvinyl acetate, acrylic, or polyurethane, as it has been found that other adhesives, particularly those containing animal products, do not tolerate temperature processing without substantial adverse effects.

In another preferred method, however, the substrate layer 14 and the clear top layer 16 are effectively fused without the need for adhesives. The top layer 16, such as a PVC sheet, and the intermediate layer 14, preferably cloth fabric, are subjected to heat and pressure in a press. This softens the PVC, adhering the fabric to it. Under optimum conditions, this preferred method enables fabric tear bond to occur, wherein the fabric is partially absorbed into the PVC. Fabric tear bond creates the strongest adhesion because of this partial absorption, substantially eliminating the possibility that the two layers will delaminate during the life of the finished mat.

Optimum fabric tear bond has been found to occur when the PVC top layer 16 and fabric intermediate layer 14 are subjected to a temperature of about 155 degrees Fahrenheit under a pressure of about 500 pounds per square centimeter for a time period of approximately 60 seconds. Although temperatures of 200 degrees Fahrenheit or more can be used for shorter periods of time, this increases the risk of curling and bubbling of the PVC, reducing the aesthetic appearance of the finished mat 10. Similarly, the temperature can be reduced, for example down to about 140 degrees Fahrenheit, being offset by greater pressures being applied for longer periods of time. This condition provides good fabric tear bond, but increases distortion as the plastic spreads, creating potentially inconsistent thickness of the top layer 16.

Once the top layer 16 and the intermediate layer 14 are bonded together, the two layer structure 18 is then adhered to the cushioned backing layer 12, preferably using pressure sensitive contact cement. The exposed surface 14*b* of the intermediate layer 14 and the top surface 12*a* of the backing layer 12 are both covered with the contact cement. After the cement has dried, the excess solvent is trimmed off. The two layer structure 18 and the backing layer 12 are then compressed together in a press. This activates the contact cement, effectively bonding the backing layer 12 to the two layer structure 18. Although pressures of about 8 pounds per square inch have been successfully used to press these layers together and create an effective bond, other pressures will probably work effectively as well.

Figure 2A:
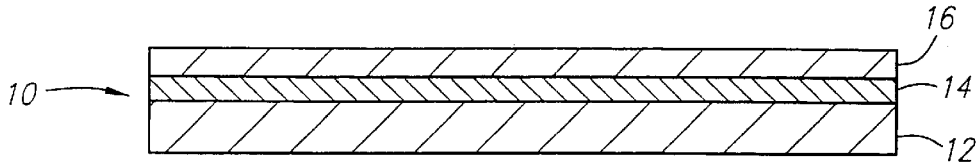
FIG. 2A shows an enlarged cross sectional view of a preferred embodiment of an assembled mat of the present invention taken along line 2—2 as shown in FIG. 1.
Figure 2B:
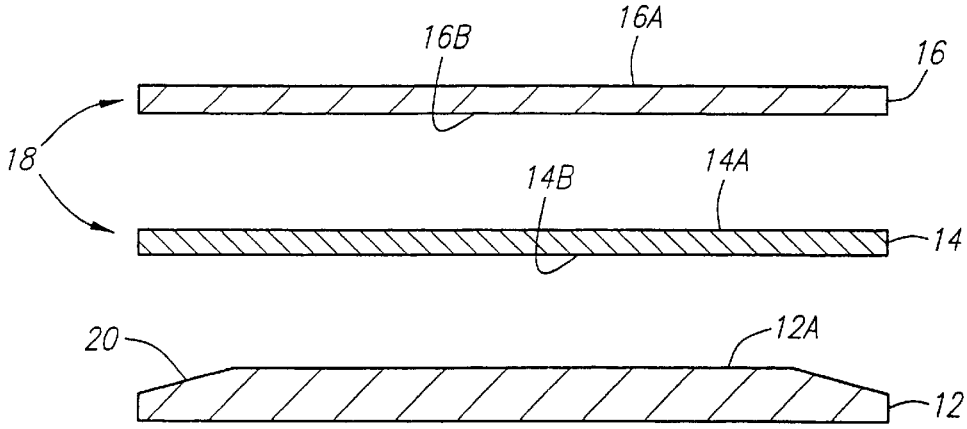
FIG. 2B shows an exploded view of the cross-sectional view of FIG. 2A.

Because of potential problems with the top layer 16 curling, in the preferred embodiment, the top surface 12*a* of the backing layer 14 has a bevel 20, preferably about 2 inches wide, around the edge of the mat (shown in FIG. 2B). When the two layer structure 18 and the backing layer 12 are compressed together, the beveled edge 20 adheres to the bottom surface 14*b* of the intermediate layer 14. This contact keeps the top layer 16 under slight tension, pulling it down towards the backing layer 12, helping to prevent the top layer 16 from curling up.

In an alternative method, the layers may be fused simply using adhesives, rather than using heat and pressure. Preferably, a substantially clear spray-on adhesive, such as Formula 77 manufactured by 3M, is sprayed onto one or preferably both of the surfaces of the layers being adhered.

For example, the sheet used for the top layer 16, and the fabric or other material used for the intermediate layer 14 may be placed on a flat surface, exposing surfaces 14*a* and 16*b*. A layer of adhesive may be sprayed onto the exposed surfaces 14*a* and 16*b*, and the intermediate layer 14 may be placed onto the top layer 16, adhering the surfaces 14*a* and 16*b*. Material for the backing layer 12 may then be placed on the flat surface, a layer of adhesive sprayed onto the surfaces 12*a* and 14*b*, and the backing layer 12 may be placed onto the intermediate layer 14, adhering the surfaces 12*a* and 14*b*. Alternatively, the intermediate layer 14 may be pre-soaked in adhesive, such as by running it through a coating machine, thus eliminating the steps of spraying adhesive onto its surfaces 14*a* and 14*b*.

Mats formed using adhesives, however, may be less favored than those made using the fabric tear bonding process (i.e. using heat and pressure to fuse the layers)

because the improved fusion obtained using the latter process substantially reduces the likelihood of delamination of the layers of the mat. However, the process may be useful to manufacture less expensive mats because using spray-on adhesives may facilitate manufacturing, and/or may eliminate the need for presses or other equipment used in the fabric tear bonding process.

In the preferred embodiment, the upper exposed surface 16*a* of the top layer 16 preferably includes a scuff-resistant pattern. The finished mat 10 may be subjected to an abrasive process such as sand blasting, or the top layer 16 may be sand-blasted before the layers are fused. This sand-blasting abrades the top surface 16*a* to make it substantially scuff-resistant while maintaining the visibility of the patterning and/or coloring of the intermediate layer 14 beneath it. The abrasion may also be used to create a slightly rough top surface 16*a* to reduce the chance of slipping on the mat by foot traffic passing over it.

Preferably, the material used for the top layer 16 is furnished with a scuff-resistant pattern preformed on the top surface 16*a*. For example, sheets for the top layer 16 are typically manufactured by directing material, such as PVC, through a pair of extrusion rollers. One of the rollers may be provided with a pattern embossed or inset onto its surface, such as by sand-blasting the surface of the roller prior to use. The pattern is then transferred or embossed onto the top surface of the sheets as they are extruded through the rollers. Alternatively, the sheets may be formed in a press or similar device, and a pattern preformed on the sheet from a sand-blasted panel of the press.

In a further alternative, the top surface 16*a* of the mat 10 may have a scuff-resistant pattern applied to it during the bonding process described above. The press used may have one of its surfaces sand-blasted. When the top layer 16, such as a PVC sheet, is subjected to the heat and pressure of the fusion process, the softened material allows the pattern to be pressed or imprinted onto the surface 16*a* simultaneous with the fusion of the layers, rather than using a separate sand-blasting step.

Because the processes described above are compatible with a multitude of materials, the intermediate substrate may contain any customized logo or design desired such that a customized floor mat is obtained.

While an embodiment of the present invention has been shown and described, various modifications may be made without departing from the scope of the present invention, and all such modifications and equivalents are intended to be covered.

What is claimed is:

1. A method for producing a decorative customized floor mat comprising the steps of:

providing an intermediate layer which provides a desired decorative design, subjecting the intermediate layer and a substantially clear top layer to heat and pressure to create a two layer bonded structure while enabling the decorative design to show through the top layer, and bonding the two layer bonded structure to a resilient backing layer, the backing layer having a thickness of between about 6 mm and about 25 mm.

2. The method of claim 1, comprising the additional step of creating a scuff-resistant surface on the clear top layer while substantially maintaining the clarity of the top layer.

3. The method of claim 2, wherein the step of creating a scuff-resistant surface comprises sand blasting an upper surface of the clear top layer.

4. The method of claim 2, wherein the step of creating a scuff-resistant surface comprises embossing a scuff-resistant pattern in the upper surface of the clear top layer.

5. The method of claim 1, wherein the step of providing an intermediate layer comprises the step of selecting a pattern and material for the intermediate layer that matches an interior design.

6. The method of claim 1, wherein the intermediate layer comprises fabric, and wherein the step of subjecting the intermediate layer and top layer to heat and pressure comprises fabric tear bonding the intermediate layer to the top layer.

7. The method of claim 1, comprising the additional step of providing a bevel around an edge of the resilient backing layer.

* * * * *